US006491213B2

(12) United States Patent
Purcell

(10) Patent No.: US 6,491,213 B2
(45) Date of Patent: Dec. 10, 2002

(54) EASY OPEN ENVELOPE

(76) Inventor: Douglas K. Purcell, 279 Casey Dr., Chicopee, MA (US) 01020

( * ) Notice: Subject to any disclaimer, the term of this patent is extended or adjusted under 35 U.S.C. 154(b) by 0 days.

(21) Appl. No.: 09/804,798

(22) Filed: Mar. 14, 2001

(65) Prior Publication Data

US 2002/0130169 A1 Sep. 19, 2002

(51) Int. Cl.[7] ..... B65D 27/38
(52) U.S. Cl. ..... 229/309; 229/312
(58) Field of Search ..... 229/309, 310, 229/311, 312, 314, 316

(56) References Cited

U.S. PATENT DOCUMENTS

| | | | | |
|---|---|---|---|---|
| 679,066 A | | 7/1901 | Timmis | |
| 1,098,175 A | * | 5/1914 | Schnitzler | 229/316 X |
| 1,099,975 A | | 6/1914 | Fitzpatrick | |
| 1,128,862 A | | 2/1915 | Fitzsimmons | |
| 1,258,062 A | | 3/1918 | Tannenbaum | |
| 1,640,685 A | | 8/1927 | Aitelli | |
| 2,162,958 A | | 6/1939 | MacDonald | |
| 2,956,727 A | * | 10/1960 | Chevan et al. | 229/309 |
| 3,182,892 A | * | 5/1965 | Paulson | 229/309 |
| 3,229,894 A | | 1/1966 | Rosenthal | |
| 3,298,598 A | * | 1/1967 | Eberstadt | 229/312 |
| 3,392,908 A | | 7/1968 | Shelley et al. | |
| 3,501,086 A | | 3/1970 | Kuniyuki | |
| 4,781,296 A | * | 11/1988 | Morris et al. | 229/309 X |

FOREIGN PATENT DOCUMENTS

| | | | | |
|---|---|---|---|---|
| FR | 1029854 | * | 6/1953 | 229/316 |

* cited by examiner

*Primary Examiner*—Jes F. Pascua
(74) *Attorney, Agent, or Firm*—Donald L. Bowman; Richard L. Schmalz

(57) ABSTRACT

An envelope comprising a tear strip that functions as an efficient opening means for access to the envelope contents.

3 Claims, 2 Drawing Sheets

EASY OPEN ENVELOPE

The invention is an easy to open envelope that provides the user easy access to its contents, by virtue of a tape strip located along one side edge of the envelope body.

BACKGROUND OF THE INVENTION

The stationery envelope has been an indispensable tool for communication throughout the last century, and, accordingly, much effort has been focused on making the design, manufacture and user-friendliness of this instrument more efficient and economical. In particular, several attempts have been made to improve the technical design of the envelope to allow the user easier access to the envelope contents, while at the same time reducing the risk of accidentally tearing the envelope body and damaging its contents or causing injury to the user.

The use of tear guides has been one means of providing simple, controlled access to the envelope contents. For example, U.S. Pat. No. 2,161,958 (MacDonald) discloses an envelope in which a cutting element is secured to the inner face of the rear section of the envelope. The cutting element, which may be a thin, twisted ribbon of cellophane, is secured between the upper and lower edges of the inner rear face of the envelope. In this position, according to the patent, the cutting element is in a concealed and inaccessible position within the envelope. Arced perforations near one or both corners of the rear section expose one or both ends of the cutting element at the back of the envelope, allowing the exposed ends to be grasped and pulled outward with a slitting motion to open the envelope.

U.S. Pat. No. 2,956,727 (Chevan) describes an envelope that includes a side strip secured to the inside of the front panel near the fold between the front and rear sections of the envelope. The portion of the strip that is between the front and rear sections has a pressure sensitive adhesive applied on either side, which permits the strip to function as a tearing member. The strip also allows functions as a re-sealing member that can be inserted between the open edges of the envelope to close it after it has been opened. An exposed portion of the strip containing no adhesive extends beyond the upper edge of the front panel, and when the envelope is sealed, this exposed portion is partially positioned beneath the upper sealing flap to provide an end or tab that can be lifted by the user and pulled to remove the strip and open the envelope.

U.S. Pat. No. 3,392,908 (Shelley) discloses a paper stationery envelope with a combination of corner guides and an internal tear strip of paper, plastic or cloth placed on the interior surface of the envelope along substantially the entire length of one or more edge folds of the envelope. The strip placed along the edge fold extends either over the entire length of the edge fold or close to the end of each edge, but, in any event, does not extend beyond the edges and there is no external indication of its presence.

This prior art, while recognizing the need for an envelope that can be torn open without detriment to the contents, has not solved the problem of providing an envelope with a reliable tear mechanism that can readily be identified by the user, and which is easy to manufacture on-line in a machine process for making envelopes.

SUMMARY OF THE INVENTION

It is therefore an object of the present invention to provide an easy-open envelope equipped with a tear mechanism that is visible to the user yet appropriately placed so as not to detract from other indicia located on the envelope, or to be accidentally snagged or otherwise engaged to permit unintentional opening of the envelope. In this respect, the invention is an envelope comprising a tape strip extending the length of one side edge of the front panel of the envelope and the corresponding region of the seal flap. Removal of the tear strip via a pull mechanism allows efficient removal of the side fold area of the envelope along a prefabricated opening while avoiding damage to the envelope contents.

In one aspect, therefore, the invention is an envelope comprising: a body formed from a front panel, the front panel having two opposing side edges, and a rear panel also having two opposing side edges; an overlapping seal flap which is foldably connected to the front panel; side flaps, each side flap being formed as an extension of a side edge of the front panel; and a tape strip affixed in contiguous, unbroken fashion along one side edge of the front panel and along the corresponding side edge of the seal flap; wherein the cut edge of the tape strip at the free edge of the seal flap is contiguous with and symmetrical in alignment to said free edge of the seal flap; a perforated region along the length of the seal flap adjacent to the tape strip; and a perforated region in the lower region of the front panel, said perforation being disposed at an angle in relation to the lower end of the tape strip; wherein a rip tab is formed by the aligned free edges of the tape strip and seal flap and said perforated region along the length of the seal flap.

The tape strip may be formed from any suitable adhesive, reinforcing material that is itself tear-resistant. For example, the tape strip may be formed form plastic tape or fiber-reinforced paper or plastic tape. Typically, the tape is adhesive-backed or is affixed to the envelope body with an adhesive. Desirably, the length of tape is not visible from the outside of the envelope. The tape strip may be formed of a transparent, colored, white or opaque material, and may optionally be printed, for example with a pattern or with text, such as advertising information.

Preferably, the tape strip is applied along one side of the front panel of an envelope blank, which has been scored and so divided into a front panel, rear panel, seal flap and side panels. The length of the tape strip may be extended beyond the length of the front panel and along the length of a corresponding region of the seal flap. Typically, before application of the tape strip to the seal flap, a gummy adhesive is applied to form a seal zone which, when adhered to the outside of the rear panel, forms the envelope closure. The tape strip may or may not overlap the seal zone, depending on the design and configuration of the seal flap. After the tape strip is applied to the blank, the corners of the seal flap are tapered by trimming the ends of the corners in an angular or curved fashion. This trimming step cuts through the excess paper substrate as well as the length of tape strip affixed to the excess substrate, and provides an identical cut line over the substrate material of the seal flap as well as the tape. After trimming, the upper free edge of the tape strip is contiguous with and symmetrically aligned to the upper free edge of the corresponding corner of the seal flap. A perforation may then be made along the region of tape affixed to the seal flap. The perforation may partially extend along the length of the tape strip, or it may extend along the entire length of the tape strip. In practice, the perforation permits the end of the tape, which is not itself covered by the gummy adhesive on the seal flap, to be lifted and torn away from the envelope body. The end of the tape strip thus forms a rip tab that allows easy initiation of the tearing action. In this respect, the seal flap and the attached rip tab so formed can be run through a stamp cancellation machine without being snagged or torn away by the equipment. An additional perforation may be included at or near the bottom of the front panel, to improve the tearing performance of the tape strip. This lower perforation may be angled between the side and lower edges of the front panel. The presence of both perforations, on the seal flap and on the lower front panel, allows the tape strip to be more precisely torn away from the envelope body such that the tear line is kept at or close to the edge of the tape strip itself.

To complete formation of the envelope, an adhesive is applied to the side flaps, after which the envelope throat is then formed by folding the rear panel to face the front panel, folding the side flaps inward, then folding and affixing the rear panel over the exteriors of the side panels.

DETAILED DESCRIPTION OF THE PREFERRED EMBODIMENTS OF THE INVENTION

Figure 1:
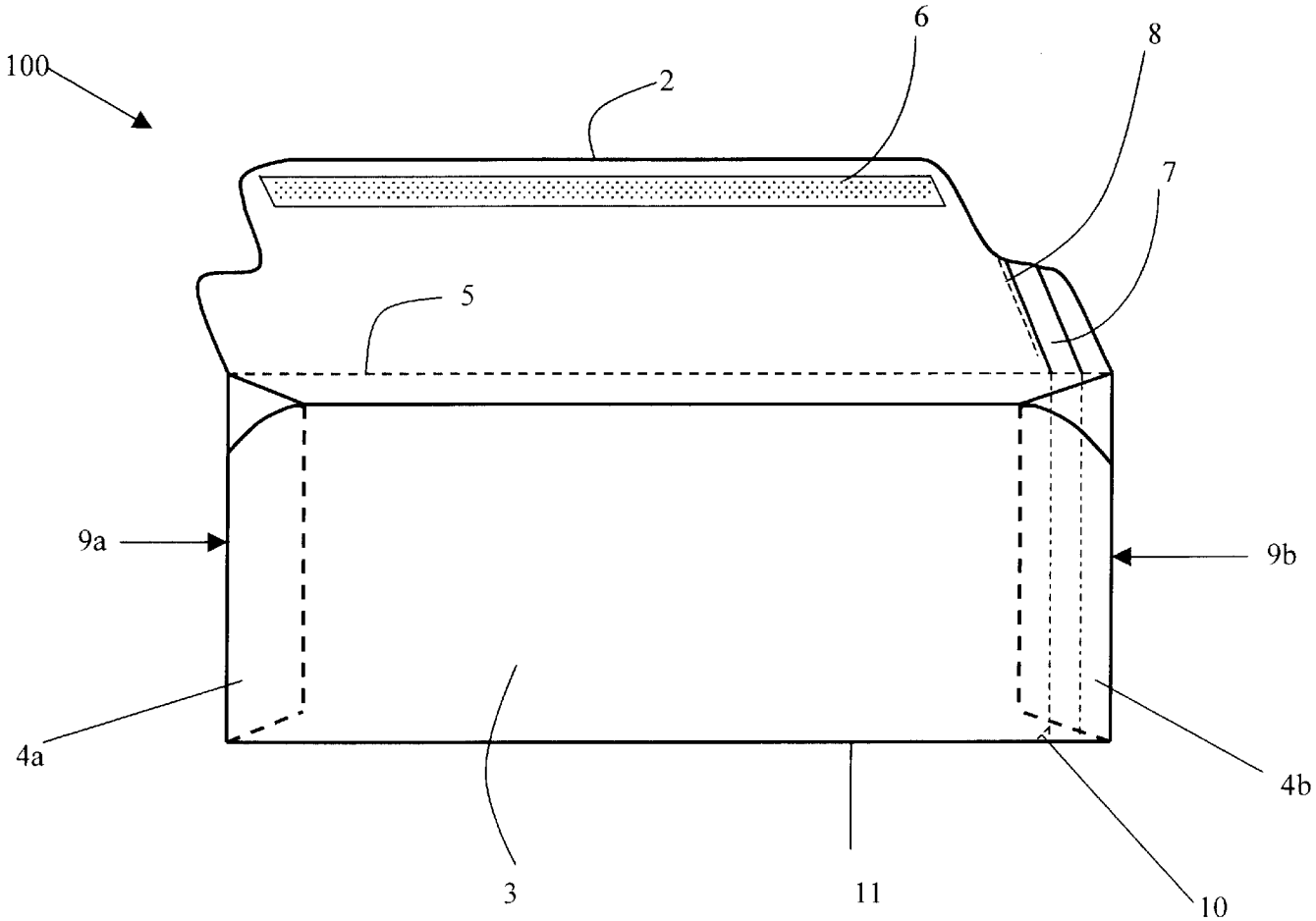
FIG. 1 is an isometric drawing of a preferred embodiment of the invention.

FIG. 1 represents one preferred embodiment of the present invention, in which the envelope 100 comprises a front panel 1, a seal flap 2 which is a vertical extension of the front panel 1, and which is separated from said front panel by a fold line 5; a rear panel 3 and side flaps 4*a* and 4*b*. Side flaps 4*a* and 4*b* are lateral extensions of the front panel 1, which are foldably connected to said front panel 1 via fold lines 9*a* and 9*b*. When the envelope is formed, side flaps 4*a* and 4*b* are folded under and attached to the interior of the rear panel 3. Seal flap 2, which is foldably connected via fold line 5 to the front panel 1, further includes an adhesive seal zone 6, which is coated with a gummy adhesive suitable for sealing the envelope 100. The gummy adhesive can be a self-sealing polymeric material, which may optionally be covered by a protective strip until it is desired that the envelope be sealed. Alternatively, the gummy adhesive may be of a type that requires moistening in order to form an effective seal. The tape strip 7, which forms the opening element of the envelope 100, is attached along the entire length of the front panel 1 close to the fold line 9*b* between front panel 1 and side panel 4*b*. In a preferred embodiment, the tape strip 7 is a strength-bearing plastic material, such as is used in packaging tape. The material employed as the tape strip in various embodiments of the invention is, however, dependent on the type of substrate used to make the body of the envelope. In this respect, the relative strength and tear resistance of the tape strip should be greater than that of the envelope substrate, to enable tearing and removal of the tape strip from the envelope body without tearing the tape strip itself.

The tape strip 7 extends across the length of the seal flap 2, and co-terminates with the edge of seal flap 2. Because the upper edge of the tape strip 7 and the upper edge of the seal flap 2 are aligned in this manner, the envelope blank can be passed through a forming machine without accidental snagging or tearing away of the tape strip 7. In addition, the formed envelope can also be sealed in a machine in the absence of similar undesirable results. Consequently, the present invention provides an efficient and therefore cost-effective product and means for mass-mailing campaigns and other applications where speed, efficiency and high volume throughput are desired. A perforation 8, which serves as a tear initiation guide, is provided near the upper edge of the tape strip 7. A second perforation 10 is also provided near the lower edge of tape strip 7 to provide a similar function. Preferably, as shown in the figures, the lower perforation 10 is positioned at an angle to the tape strip 7 to prevent the tear line from moving in the direction of the envelope body as the tear strip 7 is torn away.

Figure 2:
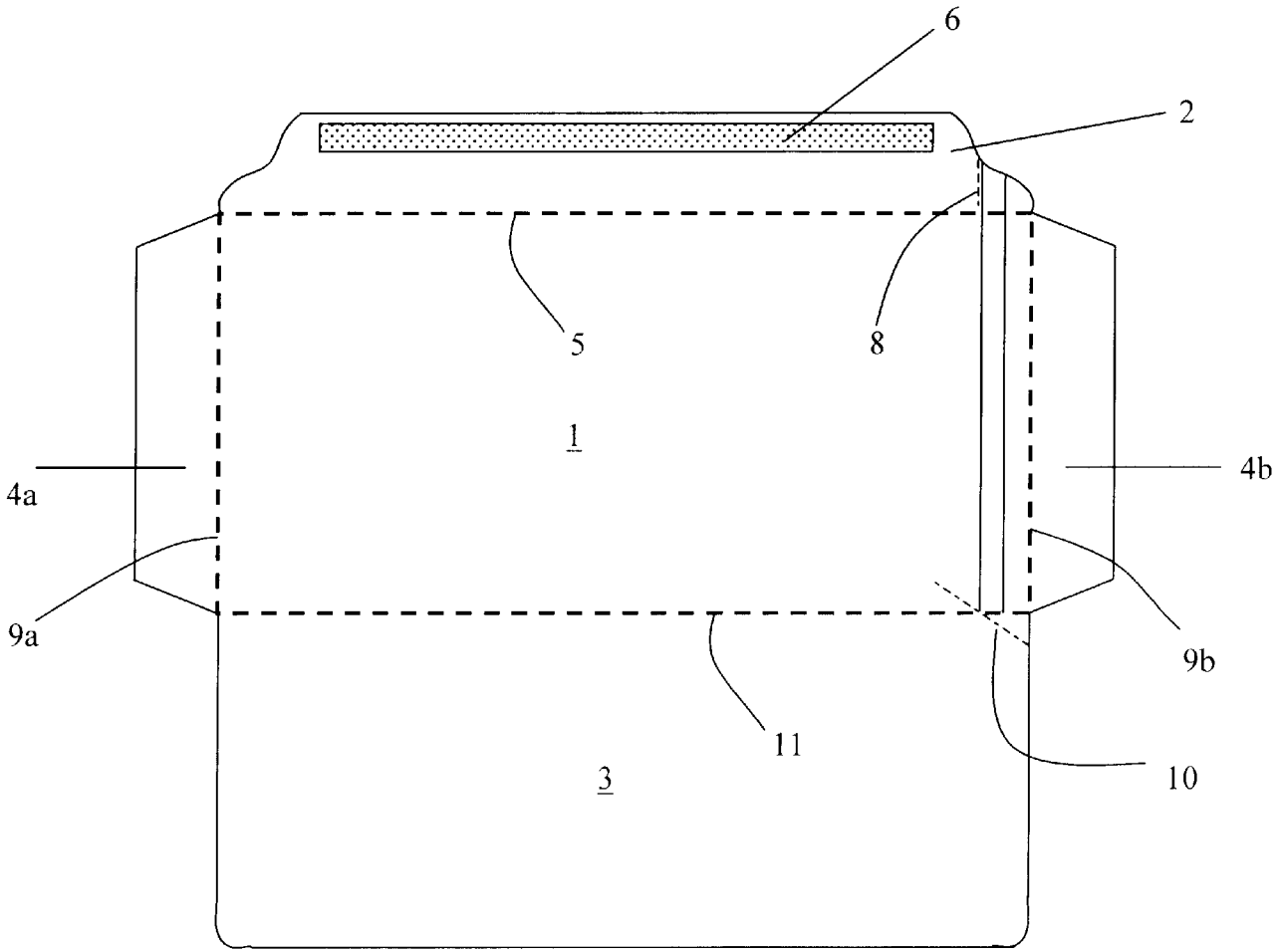
FIG. 2 is a plan drawing of a blank for forming an envelope according to the practice of the invention.

FIG. 2 is representative of a blank for forming an envelope according to one embodiment of the invention. The blank is formed by cutting a paper substrate to fit the desired dimensions. While the typical stationery envelope is formed from a bleached or unbleached paper grade in a weight range of from about sub 20 to about sub 24 (about 50 lb./ream to about 60 lb./ream, ream size 3300 ft.$^2$), it is to be understood that the invention may be applied to paper and paperboard substrates in a wide range of thickness, basis weight, density, texture and finish. The blank may be cut to provide a notched or angled seal flap, which enables formation of a seal zone 6 that is offset in relation to the side folds 9*a* and 9*b* and the tape strip 7. Fold line 5 delineates the front panel 1 from the seal flap 2, and fold lines 9*a* and 9*b* separate the laterally extended side flaps 4*a* and 4*b* from front panel 1. Rear panel 3 is separated from the front panel 1 by fold line 11.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated preferred embodiments.

I claim:

1. An envelope comprising:

a) a body formed from a front panel, said front panel having two opposing side edges, and a rear panel also having two opposing side edges;

b) an overlapping seal flap, which is foldably connected to the front panel, having two side edges and further having an upper free edge thereof;

c) side flaps, each side flap being formed as an extension of a side edge of the front panel; and d) a tape strip having an upper end and a lower end and being affixed in contiguous, unbroken fashion along one side edge of the front panel and opposite the corresponding side edge of the seal flap; wherein the upper end of the tape strip is contiguous with, and is symmetrical in alignment to, the upper free edge of the seal flap;

e) a first perforated region along the length of the seal flap adjacent and adjoining to the tape strip; said first perforated region being positioned parallel to the length of the seal flap; and f) a second perforated region in the lower region of the front panel adjacent and adjoining to the lower end of the tape strip; the length of said second perforated region being disposed along a line that is oblique in relation to the lower end of the tape strip;

wherein a rip tab for tearing the envelope open at one side is formed by the aligned free edges of the tape strip and seal flap and said first perforated region along the length of the seal flap, and the positioning of said second perforated region prevents tearing of the body of the envelope as it is torn open.

2. The envelope of claim 1, wherein the perforated region along the length of the seal flap extends along the entire length of said seal flap.

3. The envelope of claim 1, wherein the tape strip is formed from plastic or adhesive-backed polymer film.

* * * * *